US009349341B2

(12) United States Patent
Kuo

(10) Patent No.: US 9,349,341 B2
(45) Date of Patent: May 24, 2016

(54) PANEL DRIVING CIRCUIT, BOOSTER CIRCUIT FOR LIQUID CRYSTAL PIXEL DATA AND DRIVING METHOD THEREOF

(71) Applicant: AU OPTRONICS CORP., Hsin-Chu (TW)

(72) Inventor: Chien-Chih Kuo, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/556,704

(22) Filed: Dec. 1, 2014

(65) Prior Publication Data

US 2016/0055817 A1 Feb. 25, 2016

(30) Foreign Application Priority Data

Aug. 19, 2014 (TW) ..... 103128507 A

(51) Int. Cl.
*G09G 3/36* (2006.01)

(52) U.S. Cl.
CPC ..... *G09G 3/3696* (2013.01); *G09G 3/3688* (2013.01); *G09G 2310/0291* (2013.01)

(58) Field of Classification Search
CPC ..... G09G 3/36; G09G 3/3611; G09G 3/3655; G09G 3/3685; G09G 3/3688; G09G 3/3696; G09G 2310/0291
USPC ..... 345/87–89, 98–100, 204
See application file for complete search history.

(56) References Cited

U.S. PATENT DOCUMENTS

| | | | | |
|---|---|---|---|---|
| 8,674,975 | B2 | 3/2014 | Chuang et al. | |
| 2012/0169694 | A1 | 7/2012 | Chuang et al. | |
| 2014/0111491 | A1* | 4/2014 | Lee | G09G 3/3659 345/205 |

OTHER PUBLICATIONS

Taiwan Intellectual Property Office, Office Action issued Dec. 4, 2015.

* cited by examiner

*Primary Examiner* — Jennifer Nguyen
(74) *Attorney, Agent, or Firm* — WPAT, P.C.; Justin King

(57) ABSTRACT

A booster circuit for liquid crystal pixel data includes first, second and third signal control switches and a first storage capacitor. The first signal control switch is ON through a driving of a first control pulse and electrically coupled to a data voltage. The second signal control switch is ON through a driving of the first control pulse and electrically coupled to a reference voltage. The third signal control switch is ON through a driving of a second control pulse and electrically coupled to the data voltage. The first storage capacitor includes two terminals. The first storage capacitor has its first terminal electrically coupled to the reference voltage through the second signal control switch and electrically coupled to the data voltage through the third signal control switch and its second terminal electrically coupled to the data voltage through the first signal control switch and for providing an output voltage.

9 Claims, 8 Drawing Sheets

PANEL DRIVING CIRCUIT, BOOSTER CIRCUIT FOR LIQUID CRYSTAL PIXEL DATA AND DRIVING METHOD THEREOF

TECHNICAL FIELD

The present disclosure relates to a booster circuit and a driving method thereof, and more particularly to a booster circuit for liquid crystal pixel data and a driving method thereof.

BACKGROUND

With some advantages such as high quality, small size, light weight and a wide range of applications, liquid crystal display (LCD) screens have been widely used in smart phones, notebook computers, desktop monitors, televisions and other types of consumer electronics products, and have gradually replaced the traditional cathode ray tube (CRT) display screen and became one of the mainstreams in display field.

At present, high quality and high resolution is the main developing goal of LCD screen, and the frame rate is upgraded from the original 60 Hz to 240 Hz. However, the conventional liquid crystal has a limited response speed due to the material properties. In contrast, the blue phase liquid crystal (BP-LC) has some advantages such as higher response speed and no need of alignment film; for example, the response time may down to sub-milliseconds (<1 ms). Therefore, BP-LC is regarded as the future of the liquid crystal material.

Conventionally, blue phase liquid crystal exists in a quite narrow temperature range, which is about only 1~2° C. In order to enlarge the temperature range, Professor Kikuchi at Kyushu University in Japan disclosed polymer-stabilized blue phase liquid crystal (PSBP-LC) in 2002. Specifically, through doping a small amount of polymer of monomer in the blue phase liquid crystal and performing UV light irradiation, monomer is bonded into polymer according to photo polymerization and the temperature range of the BP-LC can be raised up above 60° C.

The working principle of blue phase liquid crystal is based on the Kerr effect, which indicates that the refractive index of materials will vary with the applied voltage and has a relationship $\Delta n=\lambda KE^2$, wherein $\lambda$ is the wavelength of the incident light, K is the Kerr constant, E is the electric field strength. The aforementioned polymer-stabilized blue phase liquid crystal method can successfully enlarge the temperature range of blue phase liquid crystal; however, a decreasing K is accompanied, which may result in an increasing required driving voltage.

To overcome the problem of insufficient driving voltage, one method is to employ a LCD booster circuit for raising the required driving voltage. However, because having a relatively-complicated circuit structure and a relatively-large element number, the conventional LCD booster circuit has a relatively high overall manufacturing cost. Another way to overcome the problem of insufficient driving voltage is through employing a novel manufacturing structure. For example, as illustrated in FIG. 1, a passivation 9 is formed between the substrate and the transparent conductive film (ITO) 8. Through this specific manufacturing structure, enhanced electric field efficiency is obtained at the liquid crystal driving electrode. However, the required driving voltage is still up to 30~40V even the aforementioned structure is employed; thus, it is quite difficult to apply the structure to some specific applications and in commercialization.

Therefore, it is quite necessary to design a circuit and a method capable of effectively increasing the driving voltage of the booster circuit, so that the blue phase liquid crystal is not only able to receive a sufficient driving voltage but also having a simplified circuit structure, reduced number of circuit elements and reduced cost.

SUMMARY

Therefore, an aspect of the present disclosure is to provide a display panel driving circuit capable of increasing a data voltage.

Another aspect of the present disclosure is to provide a liquid crystal pixel circuit capable of increasing a driving voltage.

Still another aspect of the present disclosure is to provide a driving method for the aforementioned liquid crystal pixel circuit.

The present disclosure provides a booster circuit for a liquid crystal pixel data, which includes a first signal control switch, a second signal control switch, a third signal control switch and a first storage capacitor. The first signal control switch is configured to be ON through a driving of a first control pulse and electrically coupled to a data voltage. The second signal control switch is configured to be ON through a driving of the first control pulse and electrically coupled to a reference voltage. The third signal control switch is configured to be ON through a driving of a second control pulse and electrically coupled to the data voltage. The first storage capacitor includes a first electrode terminal and a second electrode terminal. The first storage capacitor is configured to have its first electrode terminal electrically coupled to the reference voltage through the second signal control switch and electrically coupled to the data voltage through the third signal control switch, and its second electrode terminal electrically coupled to the data voltage through the first signal control switch and for providing an output voltage.

The present disclosure further provides a driving method for the aforementioned booster circuit. The driving method includes: providing the data voltage and the reference voltage; providing the first control pulse to the first signal control switch and the second signal control switch in a first time segment; providing the second control pulse to the third signal control switch in a second time segment; and configuring the reference voltage to have a first constant value in the first time segment and configuring the reference voltage to have a second constant value in the second time segment, wherein the first time segment is followed by the second time segment, and the first time segment and the second time segment do not overlap.

The present disclosure still further provides a panel driving circuit, which includes a data driver, at least a first data line, a booster area and at least a second data line. The data driver is configured to provide at least a data voltage. The first data line is electrically coupled to the data driver and configured to receive the data voltage. The booster area includes at least a booster circuit. The booster circuit is corresponding to the first data line and includes a first signal control switch, a second signal control switch, a third signal control switch and a first storage capacitor. The first signal control switch is configured to be ON through a driving of a first control pulse and electrically coupled to the data voltage. The second signal control switch is configured to be ON through a driving of the first control pulse and electrically coupled to a reference voltage. The third signal control switch is configured to be ON through a driving of a second control pulse and electrically coupled to the data voltage for receiving the data voltage. The first storage capacitor includes a first electrode terminal and a second electrode terminal. The first storage capacitor is configured to have its first electrode terminal electrically coupled to the reference voltage through the second signal control switch and for receiving the data voltage through the third signal control switch, and its second electrode terminal for receiving the data voltage through the first signal control switch and for providing an output voltage. The second data line is electrically coupled to the corresponding booster circuit and for receiving the output voltage and providing the output voltage to at least a corresponding pixel.

In summary, by correspondingly changing the voltage of the liquid crystal capacitor through the coupling effect of the first storage capacitor when the second receives and stores the data voltage or the reference voltage, the liquid crystal pixel circuit and the driving method thereof of the present disclosure can provide a larger driving voltage required by blue phase liquid crystal. In addition, the present disclosure has a lower manufacturing cost due to that the related circuit has a simplified circuit structure and has a smaller number of required components.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
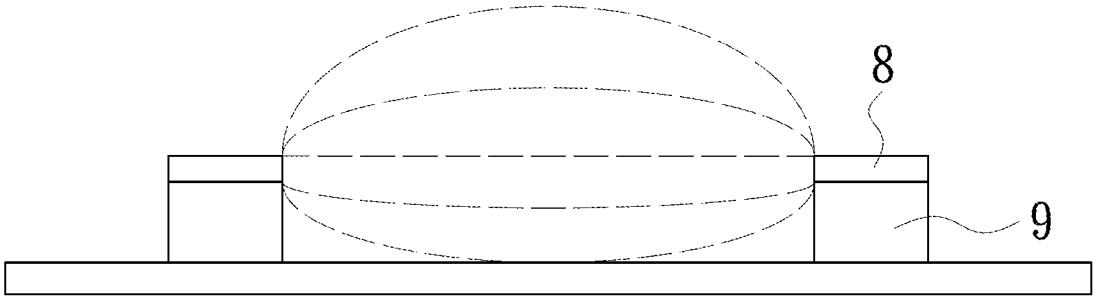
FIG. 1 (Prior Art)
FIG. 1 is a cross-sectional view of a conventional specific manufacturing structure for enhancing an electric field.
Figure 2:
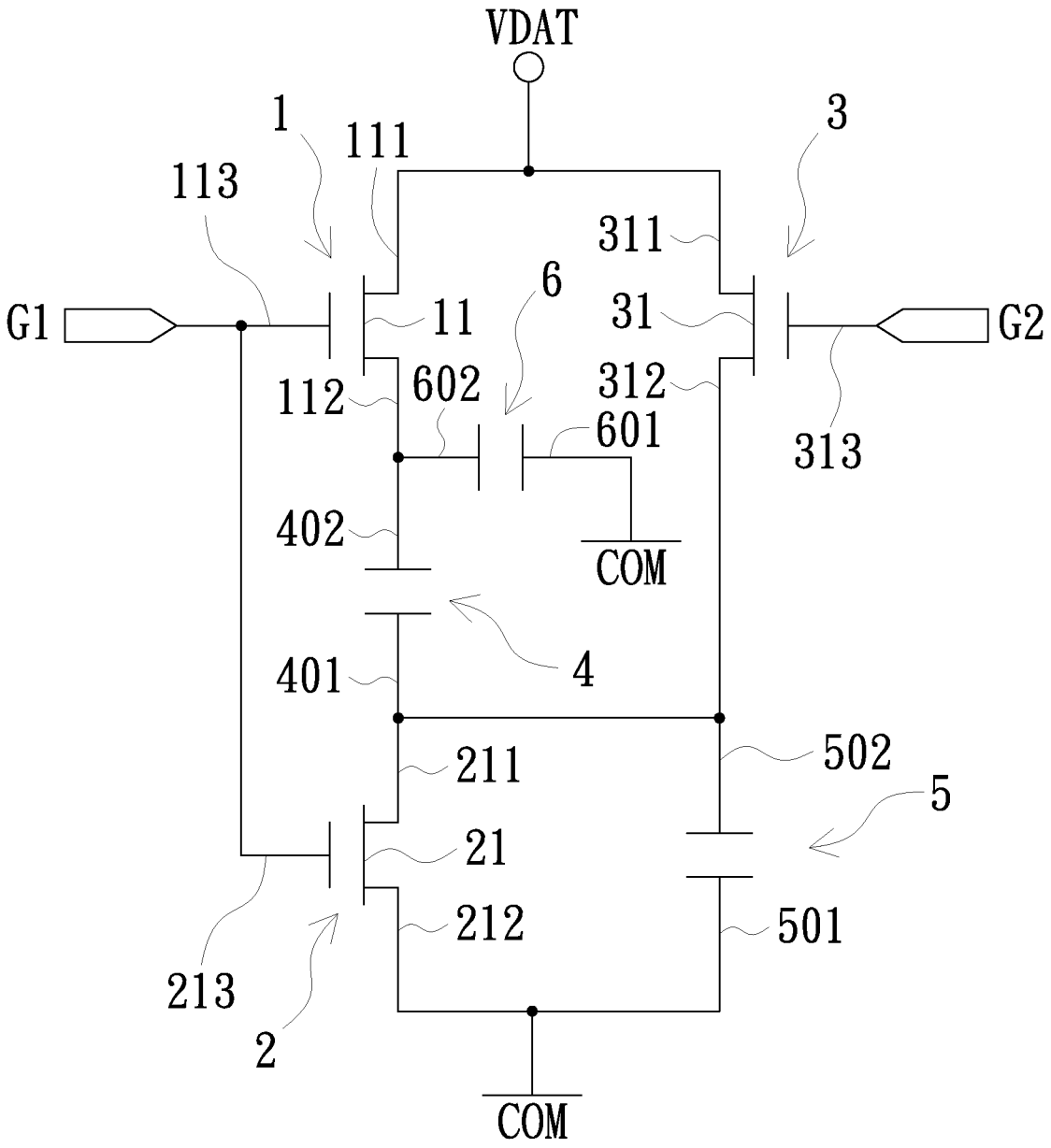
FIG. 2 is a schematic diagram of a booster circuit for liquid crystal pixel data in accordance with an embodiment of the present disclosure.

FIG. 2 is a schematic diagram of a booster circuit for liquid crystal pixel data in accordance with an embodiment of the present disclosure. As shown, the booster circuit in the present embodiment mainly includes signal control switches 1, 2, 3 (hereafter are also referred to as the first, second and third signal control switches, respectively), storage capacitors 4, 5 (hereafter are also referred to as the first and second storage capacitors, respectively) and a liquid crystal capacitor 6. The signal control switch 1 is electrically coupled to a data voltage VDAT. Specifically, the signal control switch 1 is controlled by a control signal G1 and is configured to be ON when receiving a control pulse of the control signal G1. The signal control switch 2 is electrically coupled to a reference voltage COM. Specifically, the signal control switch 2 is controlled by the control signal G1 and is configured to be ON when receiving a control pulse of the control signal G1. The signal control switch 3 is electrically coupled to the data voltage VDAT. Specifically, the signal control switch 3 is controlled by a control signal G2 and is configured to be ON when receiving a control pulse of the control signal G2.

The storage capacitor 4 has two electrode terminals 401, 402. The storage capacitor 5 has two electrode terminals 501, 502. The liquid crystal capacitor 6 has two electrode terminals 601, 602. The storage capacitor 4 is configured to have its electrode terminal 401 electrically coupled to the reference voltage COM through the signal control switch 2 and its electrode terminal 402 electrically coupled to the data voltage VDAT through the signal control switch 1. The storage capacitor 5 is configured to have its electrode terminal 501 electrically coupled to the reference voltage COM and its electrode terminal 502 electrically coupled to the data voltage VDAT through the signal control switch 3 and the electrode terminal 401 of the storage capacitor 4. The liquid crystal capacitor 6 is configured to have its electrode terminal 601 electrically coupled to the reference voltage COM and its electrode terminal 602 electrically coupled to the electrode terminal 402 of the storage capacitor 4.

In the present embodiment, the signal control switch 1 includes a transistor 11; and the transistor 11 has a source/drain terminal 111, a source/drain terminal 112 and a control gate terminal 113. The signal control switch 2 includes a transistor 21; and the transistor 21 has a source/drain terminal 211, a source/drain terminal 212 and a control gate terminal 213. The signal control switch 3 includes a transistor 31; and the transistor 31 has a source/drain terminal 311, a source/drain terminal 312 and a control gate terminal 313.

The transistor 11 is configured to have its source/drain terminal 111 electrically coupled to the data voltage VDAT, its source/drain terminal 112 electrically coupled to the electrode terminal 402 of the storage capacitor 4 and the electrode terminal 602 of the liquid crystal capacitance 6, and its control gate terminal 113 for receiving the control signals G1. The transistor 21 is configured to have its source/drain terminal 211 electrically coupled to the electrode terminal 401 of the storage capacitor 4 and the source/drain terminal 312 of the transistor 3, its source/drain terminal 212 electrically coupled to the reference voltage COM, and its control gate terminal 213 for receiving the control signals G1. The transistor 31 is configured to have its source/drain terminal 311 electrically coupled to the data voltage VDAT, its source/drain terminal 312 electrically coupled to the electrode terminal 502 of the storage capacitor 5, and its control gate terminal 313 for receiving the control signals G2. In the present embodiment, the reference voltage COM is a first voltage (e.g., 0V) in a specific frame and is a second voltage (e.g., 15V) in the next frame. Furthermore, the control pulse of the control signal G1 and the control pulse of the control signal G2 are sequentially supplied to the booster circuit of FIG. 2, and the two control pulse do not overlap.

Figure 3:
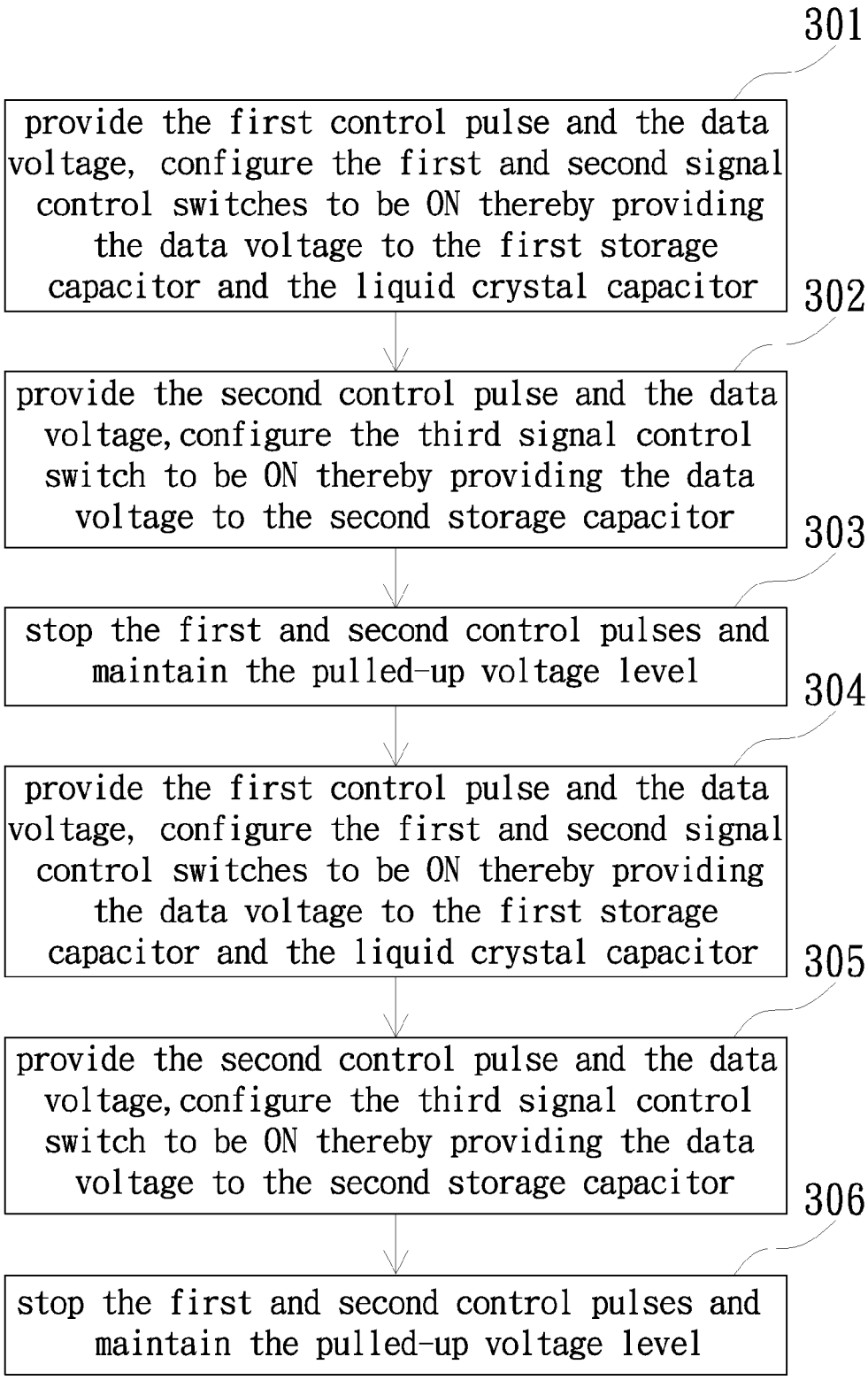
FIG. 3 is a flowchart of a driving method for a booster circuit in accordance with an embodiment of the present disclosure.
Figure 4:
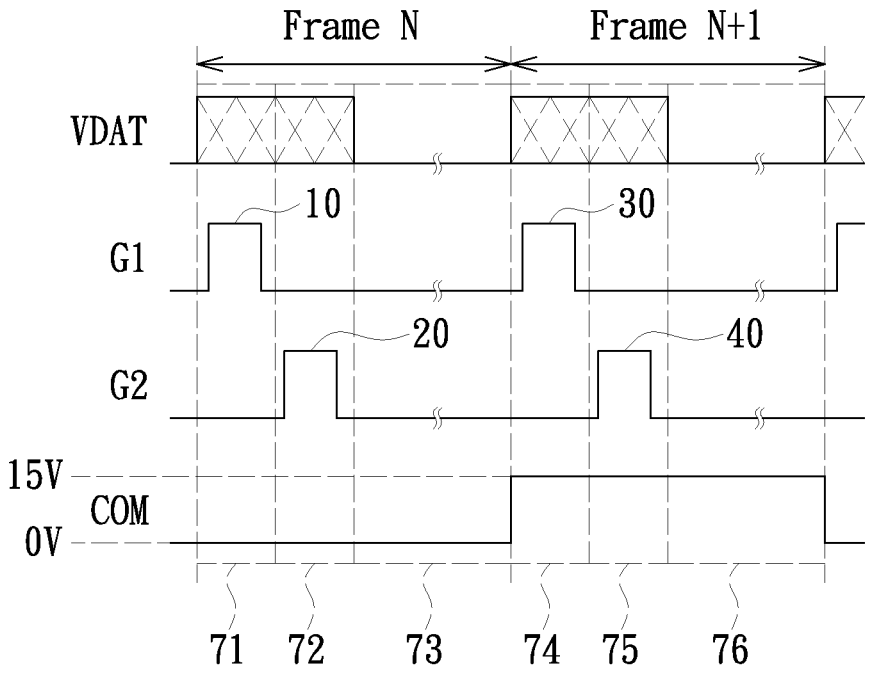
FIG. 4 is an operation timing chart of the boosting circuit of FIG. 2.

FIG. 3 is a flowchart of a driving method for a booster circuit in accordance with an embodiment of the present disclosure. FIG. 4 is an operation timing chart of the boosting circuit of FIG. 2. Please refer to FIGS. 3 and 4. In the first frame (or, in the frame N), the reference voltage COM is maintained at the first voltage (e.g., 0V). The transistor 11 is configured to have the electrical channel, formed between its source/drain terminal 111 and its source/drain terminal 112, ON/OFF according to the voltage level of the control signal G1 received by its control gate terminal 113. For example, the electrical channel formed between the source/drain terminal 111 and the source/drain terminal 112 is OFF when the control signal G1 has a low level; alternatively, the electrical channel is ON when the control signal G1 has a high level. Thus, when the control pulse 10 of the control signal G1 is supplied to the control gate terminal 113 of the transistor 11 in the time segment 71, the electrical channel between source/drain terminal 111 and source/drain terminal 112 is ON; and accordingly the data voltage VDAT is transmitted from the source/drain terminal 111 to the source/drain terminal 112 and then is stored in the storage capacitor 4 and the liquid crystal capacitor 6.

Similarly, the transistor 21 is configured to have the electrical channel, formed between its source/drain terminal 211 and its source/drain terminal 212, ON/OFF according to the voltage level of the control signal G1 received by its control gate terminal 213. Specifically, when the control pulse 10 of the control signal G1 is supplied to the control gate terminal 213 of the transistor 21 in the time segment 71, the electrical channel between source/drain terminal 211 and source/drain terminal 212 is ON; and accordingly the reference voltage COM is transmitted from the source/drain terminal 212 to the source/drain terminal 211.

As a result, in the time segment 71, both of the voltages at the electrode terminal 401 of the storage capacitor 4 and the electrode terminal 502 of the storage capacitor 5 are approximately equal to the reference voltage COM, and both of the voltages at the electrode terminal 402 of the storage capacitor 4 and the electrode terminal 602 of the liquid crystal capacitor 6 are approximately equal to the data voltage VDAT.

Similarly, the transistor 31 is configured to have the electrical channel, formed between its source/drain terminal 311 and its source/drain terminal 312, ON/OFF according to the voltage level of the control signal G2 received by its control gate terminal 313. Thus, when the control pulse 20 of the control signal G2 is supplied to the control gate terminal 313 of the transistor 31 in the time segment 72 which is right after the time segment 71, the electrical channel between the source/drain terminal 311 and the source/drain terminal 312 of the transistor 31 is ON; and accordingly the data voltage VDAT is transmitted from the source/drain terminal 311 to the source/drain terminal 312 of the transistor 31 and then is stored in the storage capacitor 5 thereby changing the voltages at the electrode terminal 401 of the storage capacitor 4 and the electrode terminal 502 of the storage capacitor 5. As a result, the voltages at the electrode terminals 401, 502 increase from the reference voltage COM and eventually reach to and maintain at the data voltage VDAT if time is allowed. In addition, because the coupling effect occurring between the two terminals of the storage capacitor 4, the voltage at the electrode terminal 402 of the storage capacitor 4 also changes in the time segment 72. Specifically, the voltage change at the electrode terminal 402 of the storage capacitor 4 is about VDAT−COM; and consequentially the voltage at the electrode terminal 602 of the liquid crystal capacitor 6 is pulled up to about 2*VDAT−COM in the time segment 72. Because the electrode terminal 601 of the liquid crystal capacitor 6 is maintained at the reference voltage COM, the voltage difference between the electrode terminals 601, 602 of the liquid crystal capacitor 6 is pulled up to about 2*(VDAT−COM). It is to be noted that the time segments 71, 72 do not overlap and the reference voltage COM is maintained at a low voltage level with a constant value, for example, 0V.

Then, in the time segment 73, both of the control signals G1, G2 have a low voltage level; thus, all of the signal control switches 1, 2, 3 are OFF. As a result, the liquid crystal capacitor 6 is configured to keep supplying a sufficient voltage (i.e., 2*(VDAT−COM)) to drive the blue phase liquid crystals until at the end of the first frame (Frame N).

It is to be noted that the aforementioned embodiment also applies to that the reference voltage COM has varying voltage level. In one embodiment when the reference voltage COM has a voltage level higher than that of the data voltage VDAT, the liquid crystal capacitor 6 may have a different voltage difference between the two terminals. The operation of the booster circuit of FIG. 2 when the reference voltage COM has a high voltage level in the second frame (Frame N+1) will be described as follow.

Then, in the next frame (Frame N+1), the reference voltage COM is converted from the first voltage (e.g., 0V) to the second voltage (e.g., 15V). Specifically, when the control pulse 30 of the control signal G1 is supplied to the control gate terminal 113 of the transistor 11 in the time segment 74, the electrical channel between source/drain terminal 111 and source/drain terminal 112 of the transistor 11 is ON; accordingly the data voltage VDAT is transmitted from the source/drain terminal 111 to the source/drain terminal 112 of the transistor 11. Similarly, when the control pulse 30 of the control signal G1 is supplied to the control gate terminal 213 of the transistor 21 in the time segment 74, the electrical channel between source/drain terminal 211 and source/drain terminal 212 of the transistor 21 is ON; accordingly the reference voltage COM is transmitted from the source/drain terminal 211 to the source/drain terminal 212 of the transistor 21. As a result, in the time period 74, the voltage at the source/drain terminal 211 of the transistor 21 (as well as the electrode terminal 401 of the storage capacitor 4 and the electrode terminal 502 of the storage capacitor 5) is approximately equal to the reference voltage COM; and the voltage at the source/drain terminal 112 of the transistor 11 (as well as the electrode terminal 402 of the storage capacitor 4 and the electrode terminal 602 of the liquid crystal capacitor 6) is approximately equal to the data voltage VDAT. In other words, same as in the time segment 71, the voltage difference between the two electrode terminals of the storage capacitor 4 and the voltage difference between the two electrode terminals of the liquid crystal capacitor 6 in the time segment 74 are VDAT−COM. However, it is to be noted that the data voltage VDAT has a higher voltage level in the time segment 71 but the reference voltage COM has a higher voltage level in the time segment 74.

Then, when the control pulse 40 of the control signal G2 is supplied to the control gate terminal 313 of the transistor 31 in the time segment 75, the electrical channel between the source/drain terminal 311 and the source/drain terminal 312 of the transistor 31 is ON; and accordingly the data voltage VDAT is transmitted from the source/drain terminal 311 to the source/drain terminal 312 of the transistor 31 and then is stored in the storage capacitor 5 thereby changing the voltages at the electrode terminal 401 of the storage capacitor 4 and the electrode terminal 502 of the storage capacitor 5. As a result, the voltages at the electrode terminals 401, 502 increase from the reference voltage COM and eventually reach to and maintain at the data voltage VDAT if time is allowed. In addition, because the coupling effect occurring between the two terminals of the storage capacitor 4, the voltage at the electrode terminal 402 of the storage capacitor 4 and the electrode terminal 602 of the liquid crystal capacitor 6 also change in the time segment 75. As a result, the voltage difference between the two terminals of the liquid crystal capacitor 6 is raised up in the time segment 75.

As previously described, both of the voltages at the electrode terminals 402 and 602 are approximately equal to the data voltage VDAT in the time segment 74. In the time segment 75, both of the voltages at the electrode terminals 402 and 602 changes due to the coupling effect. Because the reference voltage COM is higher than the data voltage COM VDAT, the voltages at the electrode terminals 402 and 602 are dropped with (COM-VDAT). In other words, the eventual voltages at the electrode terminals 402 and 602 in the time segment 75 are approximately equal to:

$$VDAT-(COM-VDAT)=2*VDAT-COM$$

Thus, the voltage applied to the two terminals of the liquid crystal capacitor 6 is approximately equal to:

$$COM-(2*VDAT-COM)=2*(COM-VDAT)$$

In other words, the voltage difference between the two terminals of the liquid crystal capacitor 6 in the time segment 75 also increases to about 2*(VDAT−COM), which is same as that in the time segment 72 but has an opposite phase.

Then, in the time segment 76, both of the control signals G1, G2 have a low voltage level; thus, all of the signal control switches 1, 2, 3 are OFF. As a result, the liquid crystal capacitor 6 is configured to keep supplying a sufficient voltage (i.e., 2*(VDAT−COM)) to drive the blue phase liquid crystals until at the end of the second frame (Frame N+1).

According to the above description, driving method for a booster circuit in accordance with an embodiment of the present disclosure as illustrated in FIG. 3 can be summarized to have the following steps: provide the first control pulse and the data voltage, configure the first and second signal control switches to be ON thereby providing the data voltage to the first storage capacitor and the liquid crystal capacitor (step 301); provide the second control pulse and the data voltage, configure the third signal control switch to be ON thereby providing the data voltage to the second storage capacitor (step 302); stop the first and second control pulses and maintain the pulled-up voltage level (step 303); provide the first control pulse and the data voltage, configure the first and second signal control switches to be ON thereby providing the data voltage to the first storage capacitor and the liquid crystal capacitor (step 304); provide the second control pulse and the data voltage, configure the third signal control switch to be ON thereby providing the data voltage to the second storage capacitor (step 305); and stop the first and second control pulses and maintain the pulled-up voltage level (step 306).

Figure 5:
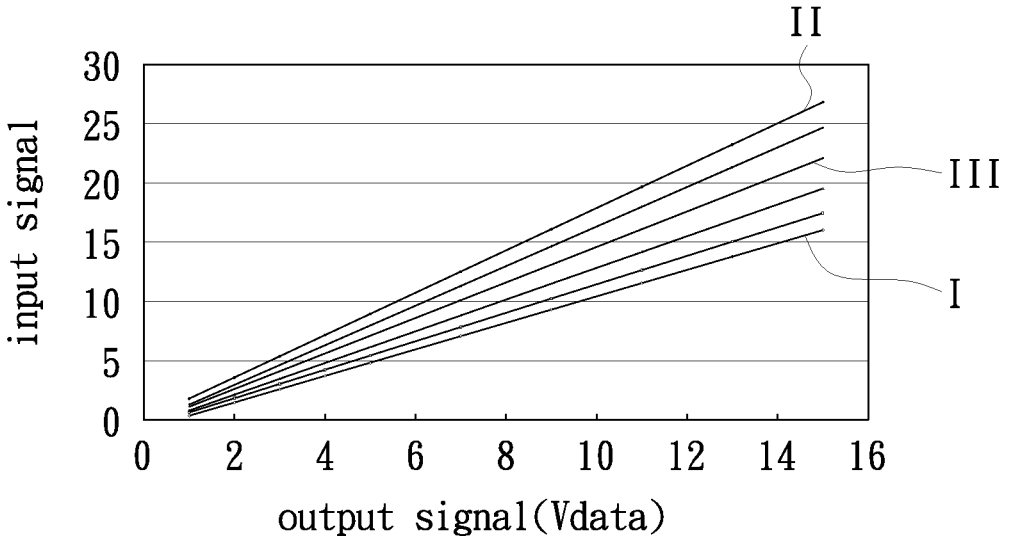
FIG. 5 is a chart of a capacitance ratio of the storage capacitor to the liquid crystal capacitor shown in FIG. 2.

Referring to FIG. 5, which is a chart of a capacitance ratio of the storage capacitor 4 to the liquid crystal capacitor 6; wherein the curves in FIG. 5 are obtained based on configuring the reference voltage COM to 0V. As shown, when the ratio is 0.125 (the curve I), the output voltage (corresponding to the voltage between the two electrode terminals of the liquid crystal capacitor 6) is raised up to about 15V if the input voltage (corresponding to the data voltage) is 14V. When the ratio is 4 (the curve II), the output voltage is further raised up to about 25V if the input voltage is still 14V. It is understood that the ability of storing charges and the voltage difference between the two electrode terminals of the storage capacitor 4 increase with the capacitance of the storage capacitor 4. Thus, in theory, it is better to have a larger ratio of the storage capacitor 4 to the liquid crystal capacitor 6. However, it is proper to configure the ratio in a range from 0.125 to 4 after the consideration of the factors of the component size, cost and driving time. In one embodiment, an improved voltage-boosting efficiency is obtained by configured the capacitance ratio of the storage capacitor 4 to the liquid crystal capacitor 6 to 1~4.

Figure 6:
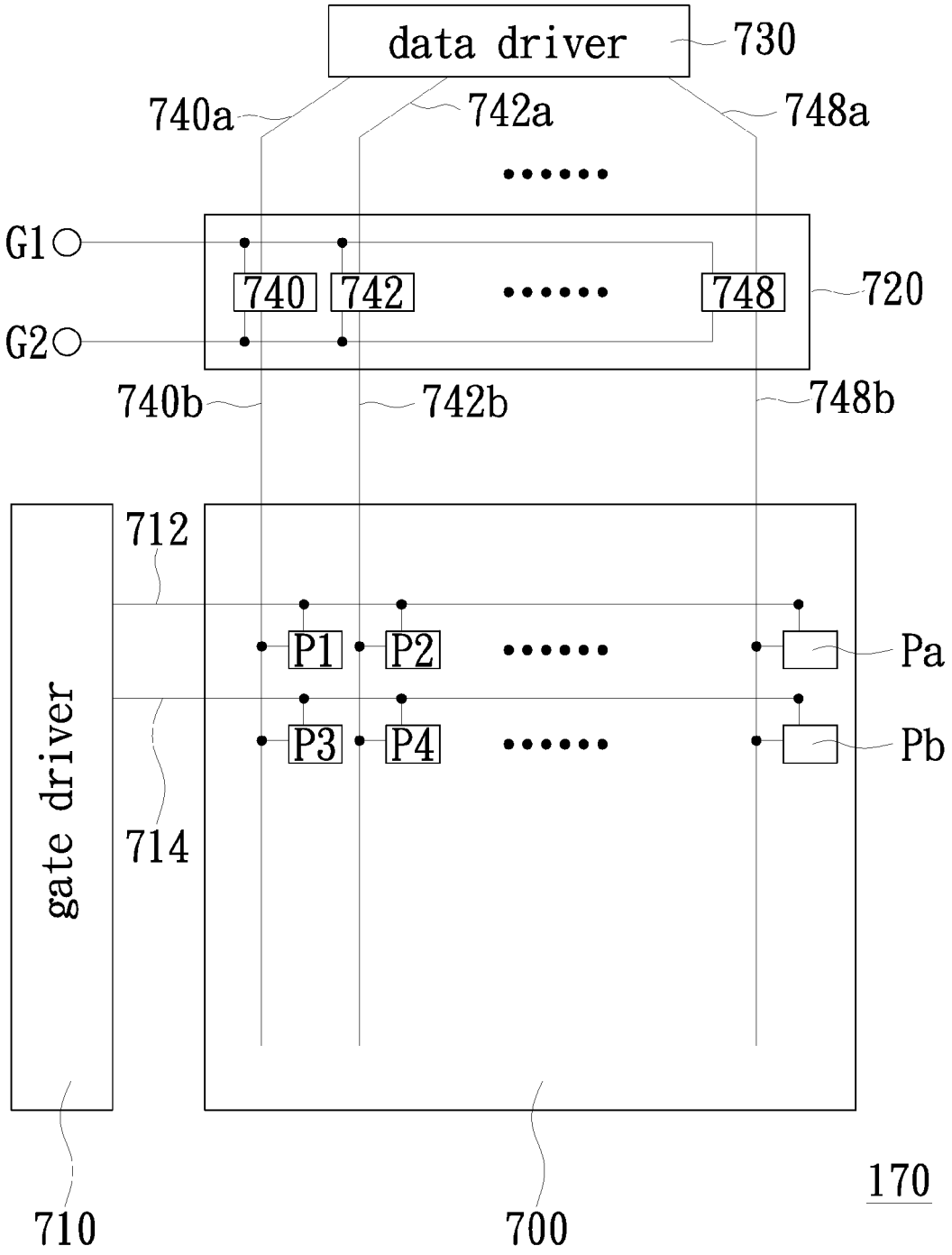
FIG. 6 is a schematic circuit block diagram of a liquid crystal display panel in accordance with an embodiment of the present disclosure.

The booster circuit is integrated into the pixel circuit in the above embodiment; thus, the electrode terminal 402 of the storage capacitor 4 is electrically coupled to the liquid crystal capacitor 6. However, besides being disposed in the pixel circuit, the booster circuit may be disposed at other positions. Please refer to FIG. 6, which is a schematic circuit block diagram of a liquid crystal display panel in accordance with an embodiment of the present disclosure. As shown, the liquid crystal display panel 170 in the present embodiment includes a display area 700, a gate driver 710, a booster area 720 and a data driver 730. The display area 700 includes a plurality of pixel circuits, such as pixel circuits P1, P2, P3, P4, Pa and Pb. Each pixel circuit corresponds to one data line and one gate line. For example, the pixel circuit P1 is electrically coupled to the data line 740*b* and the gate line 712 and is configured to determine whether to receive the data being transmitted on the data line 740*b* or not according to a control of the gate line 712. In other words, the gate driver 710 is configured to provide a respective gate driving signal to the gate lines 712, 714 and the data driver 730 is configured to provide a respective data signal to the data lines 740*a*, 742*a* and 748*a*.

Being different with a conventional liquid crystal display panel, the liquid crystal display panel in the present disclosure further includes a booster area 720 disposed between the data driver 730 and the display area 700. The booster region 720 includes a plurality of booster circuits, such as the booster circuits 740, 742 and 748. In one embodiment, a panel driving circuit is defined as mainly including the data driver 730, data lines 740*a*~748*a*, data lines 740*b*~748*b* and the booster area 720. Each booster circuit (such as the booster circuit 740) may be implemented with the booster circuit of FIG. 2 by being omitted with the liquid crystal capacitor 6 and directly referring the voltage transmitted by the data line 740*a* as the data voltage VDAT and electrically coupling the electrode terminal 402 of the storage capacitor 4 to the data line 740*b* as an output of the booster circuit 740. Similarly, the booster circuit 742 and 748 use the voltages transmitted by the data lines 742*a* and 748*a* as the data voltage VDAT and use the data lines 742*b* and 748*b* as the outputs, respectively. In another circuit design, the booster area 720 may be directly manufactured in the data driver 730; and it is understood that the eventual voltage boosting result has no difference and the liquid crystal display panel originally having no voltage boosting ability can have the voltage boosting effect provided by the present disclosure by replacing the data driver.

Figure 7:
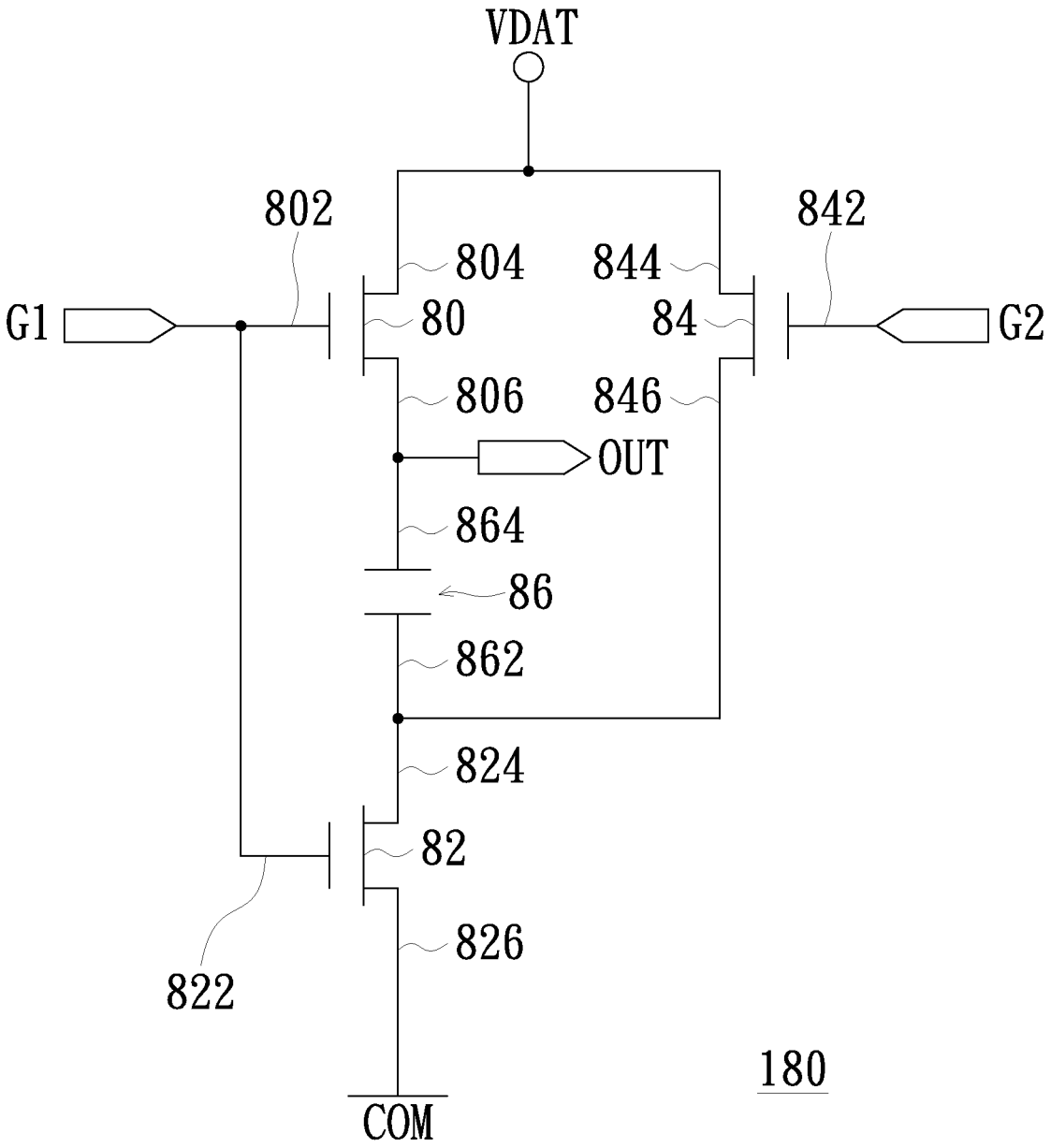
FIG. 7 is a schematic diagram of a booster circuit in accordance with another embodiment of the present disclosure.

By being provided with the storage capacitor 5, the booster circuit of FIG. 2 is suitable for being used in the pixel circuit requiring a long-term stable voltage. Alternatively, the storage capacitor 5 may be omitted when the booster circuit of FIG. 2 is only for voltage boosting such as the booster circuits 740~748 are. FIG. 7 is a schematic diagram of a booster circuit in accordance with another embodiment of the present disclosure. As shown, the booster circuit 180 in the present embodiment includes a signal control switches 80, 82 and 84 and a storage capacitor 86. The signal control switch 80 is implemented with an N-type transistor and has a control gate terminal 802, a source/drain terminal 804 and a source/drain terminal 806. The signal control switch 82 is implemented with an N-type transistor and has a control gate terminal 822, a source/drain terminal 824 and a source/drain terminal 826. The signal control switch 84 is implemented with an N-type transistor and has a control gate terminal 842, a source/drain terminal 844 and a source/drain terminal 846. The storage capacitor 86 has two electrode terminals 862 and 864.

As shown, the control gate terminal 802 receives the control signal G1; the source/drain terminal 804 receives the data voltage VDAT; and the source/drain terminal 806 is electrically coupled to the output terminal OUT and the electrode terminal 864 of the storage capacitor 86. Thus, the signal control switch 80 is configured to determine the ON/OFF of an electrical channel between the source/drain terminal 804 (or, the data voltage VDAT) and the source/drain terminal 806 according to the voltage level of the control signal G1. The control gate terminal 822 receives the control signal G1; the source/drain terminal 826 receives the reference voltage COM; and the source/drain terminal 824 is electrically coupled to the electrode terminal 862 of the storage capacitor 86. Thus, the signal control switch 82 is configured to determine the ON/OFF of an electrical channel between the source/drain terminal 826 (or, the reference voltage COM) and the source/drain terminal 824 according to the voltage level of the control signal G1. The control gate terminal 842 receives the control signal G2; the source/drain terminal 844 receives the data voltage VDAT; and the source/drain terminal 846 is electrically coupled to the electrode terminal 862 of the storage capacitor 86. Thus, the signal control switch 84 is configured to determine the ON/OFF of an electrical channel between the source/drain terminal 844 (or, the data voltage VDAT) and the source/drain terminal 846 according to the voltage level of the control signal G2.

The booster circuit 180 in the present embodiment of FIG. 7 has a circuit structure similar to that of FIG. 2. The main difference between the two booster circuits is that the booster circuit 180 in the present embodiment has simplified circuit structure and smaller required layout area due to being omitted with the storage capacitor 5, compared with the booster circuit of FIG. 2. In addition, the driving method for the booster circuit 180 of FIG. 7 may be completely same as that for the booster circuit of FIG. 2, and no redundant detail is to be given herein.

Figure 8:
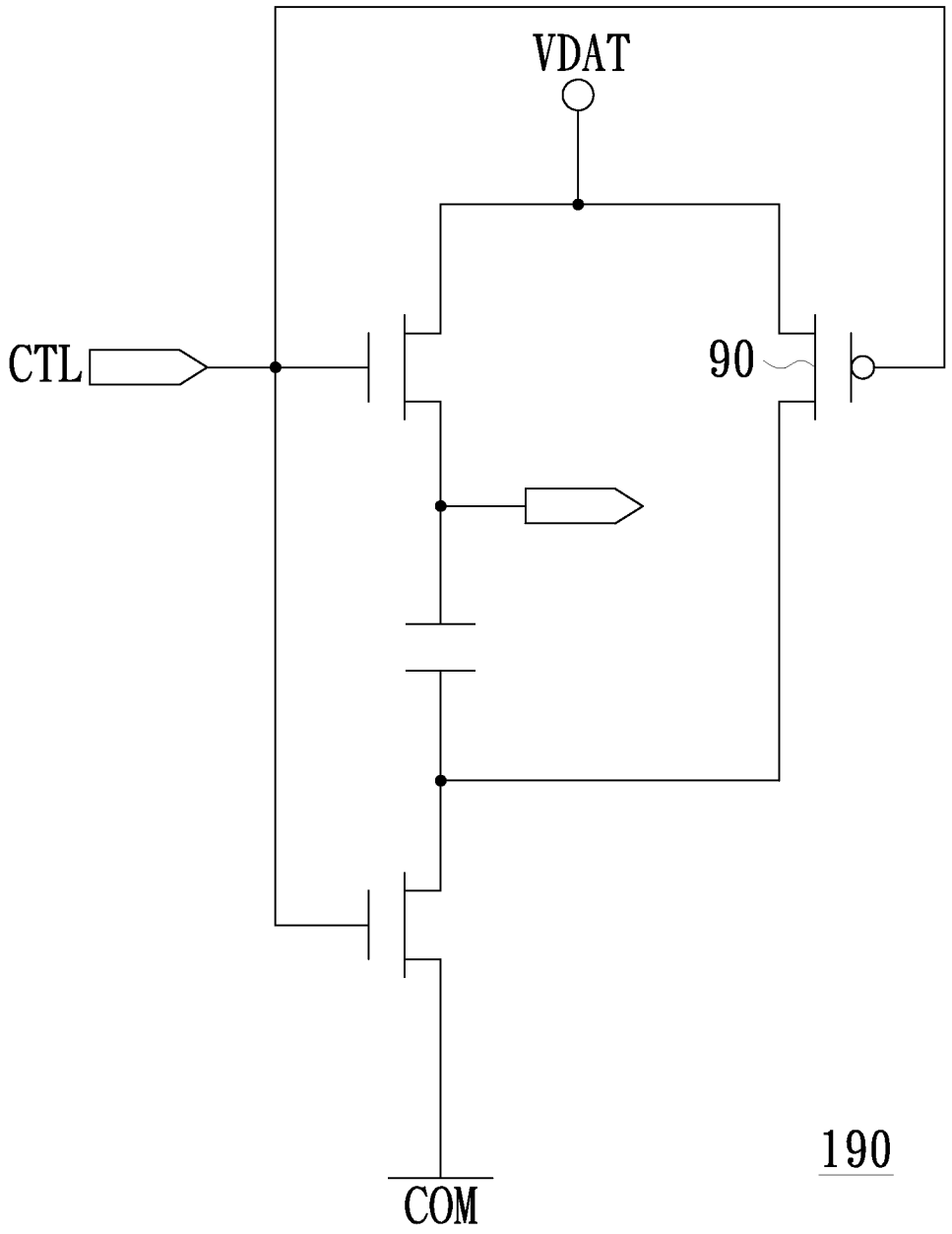
FIG. 8 is a schematic diagram of a booster circuit in accordance with another embodiment of the present disclosure.

Further, it is to be noted that the number of the required input control signal may be reduced by changing the type of the transistor in the booster circuit. Please refer to FIG. 8, which is a schematic diagram of a booster circuit in accordance with another embodiment of the present disclosure. As shown, the booster circuit 190 in the present embodiment has a circuit structure similar to the booster circuit 180 of FIG. 7. The main difference between the two booster circuits is that the signal control switch 90 in the booster circuit 190 of FIG. 8 is a P-type transistor but the corresponding signal control switch 84 in the booster circuit 180 of FIG. 7 is an N-type transistor, and the booster circuit 190 is configured to have its control gate terminal for receiving the control signal CTL same as the control gate terminals of other signal control switches. In other words, the booster circuit 190 in the present embodiment needs only one type of control pulse but the booster circuits in other embodiments use two types of control pulse. Although having the aforementioned differences, it is understood that the booster circuit 190 in the present embodiment and the booster circuit 180 of FIG. 7 have the similar operation way, and no redundant detail is to be given herein.

In summary, by correspondingly changing the voltage of the liquid crystal capacitor through the coupling effect of the first storage capacitor when the second receives and stores the data voltage or the reference voltage, the liquid crystal pixel circuit and the driving method thereof of the present disclosure can provide a larger driving voltage required by blue phase liquid crystal. In addition, the present disclosure has a lower manufacturing cost due to that the related circuit has a simplified circuit structure and has a smaller number of required components.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A booster circuit for a liquid crystal pixel data, comprising:

a first signal control switch, configured to be ON through a driving of a first control pulse and electrically coupled to a data voltage;

a second signal control switch, configured to be ON through a driving of the first control pulse and electrically coupled to a reference voltage;

a third signal control switch, configured to be ON through a driving of a second control pulse and electrically coupled to the data voltage;

a first storage capacitor, comprising a first electrode terminal and a second electrode terminal, the first storage capacitor being configured to have its first electrode terminal electrically coupled to the reference voltage through the second signal control switch and electrically coupled to the data voltage through the third signal control switch, and its second electrode terminal electrically coupled to the data voltage through the first signal control switch and for providing an output voltage;

a second storage capacitor, comprising a first electrode terminal and a second electrode terminal, the second storage capacitor being configured to have its first electrode terminal electrically coupled to the reference voltage and its second electrode terminal electrically coupled to the data voltage through the third signal control switch; and a liquid crystal capacitor, comprising a first electrode terminal and a second electrode terminal, the liquid crystal capacitor being configured to have its first electrode terminal electrically coupled to the reference voltage and its second electrode terminal electrically coupled to the second electrode terminal of the first storage capacitor;

wherein a ratio of a capacitance value of the first storage capacitor to a capacitance value of the liquid crystal capacitor is in a range from 0.125 to 4.

2. The booster circuit according to claim 1, wherein the first signal control switch and the second signal control switch are configured to be ON at the same time and the first signal control switch and the third signal control switch are configured not to be ON at the same time.

3. The booster circuit according to claim 1, wherein the first signal control switch comprises a transistor, the transistor comprises a first source/drain terminal, a second source/drain terminal and a control gate terminal, the first source/drain terminal is electrically coupled to the data voltage, the second source/drain terminal is electrically coupled to the second electrode terminal of the first storage capacitor, the control gate terminal is for receiving the first control pulse, the transistor is configured to control the ON/OFF of an electrical channel between the first source/drain terminal and the second source/drain terminal according to the first control pulse.

4. The booster circuit according to claim 1, wherein the second signal control switch comprises a transistor, the transistor comprises a first source/drain terminal, a second source/drain terminal and a control gate terminal, the first source/drain terminal is electrically coupled to the first electrode terminal of the first storage capacitor, the second source/drain terminal is electrically coupled to the reference voltage, the control gate terminal is for receiving the first control pulse, the transistor is configured to control the ON/OFF of an electrical channel between the first source/drain terminal and the second source/drain terminal according to the first control pulse.

5. The booster circuit according to claim 1, wherein the third signal control switch comprises a transistor, the transistor comprises a first source/drain terminal, a second source/drain terminal and a control gate terminal, the first source/drain terminal is electrically coupled to the data voltage, the second source/drain terminal is electrically coupled to the first electrode terminal of the first storage capacitor, the control gate terminal is for receiving the second control pulse, the transistor is configured to control the ON/OFF of an electrical channel between the first source/drain terminal and the second source/drain terminal according to the second control pulse.

6. The booster circuit according to claim 1, wherein the capacitance value of the liquid crystal capacitor is not greater than the capacitance value of the first storage capacitor.

7. The booster circuit according to claim 6, wherein a ratio of the capacitance value of the first storage capacitor to the capacitance value of the liquid crystal storage capacitor is in a range from 1 to 4.

8. A driving method for a booster circuit, the booster circuit comprising a first signal control switch, a second signal control switch, a third signal control switch, a first storage capacitor and a liquid crystal capacitor, the first signal control switch being configured to be ON through a driving of a first control pulse and electrically coupled to a data voltage, the second signal control switch being configured to be ON through a driving of the first control pulse and electrically coupled to a reference voltage, the third signal control switch being configured to be ON through a driving of a second control pulse and electrically coupled to the data voltage, the first storage capacitor comprising a first electrode terminal and a second electrode terminal, the first storage capacitor being configured to have its first electrode terminal electrically coupled to the reference voltage through the second signal control switch and electrically coupled to the data voltage through the third signal control switch, and its second electrode terminal electrically coupled to the data voltage through the first signal control switch and for providing an output voltage, the liquid crystal capacitor comprising a first electrode terminal and a second electrode terminal, the liquid crystal capacitor being configured to have its first electrode terminal electrically coupled to the reference voltage and its second electrode terminal electrically coupled to the second electrode terminal of the first storage capacitor, the driving method comprising:

providing the data voltage and the reference voltage;

providing the first control pulse to the first signal control switch and the second signal control switch in a first time segment;

providing the second control pulse to the third signal control switch in a second time segment; and configuring the reference voltage to have a first constant value in the first time segment and configuring the reference voltage to have a second constant value in the second time segment, wherein the first time segment is followed by the second time segment, and the first time segment and the second time segment do not overlap, a ratio of a capacitance value of the first storage capacitor to a capacitance value of the liquid crystal storage capacitor is in a range from 0.125 to 4.

9. A panel driving circuit, comprising:

a data driver, configured to provide at least a data voltage;

at least a first data line, electrically coupled to the data driver and configured to receive the data voltage;

a booster area, comprising at least a booster circuit, the booster circuit being corresponding to the first data line and comprising:

a first signal control switch, configured to be ON through a driving of a first control pulse and electrically coupled to the data voltage;

a second signal control switch, configured to be ON through a driving of the first control pulse and electrically coupled to a reference voltage;

a third signal control switch, configured to be ON through a driving of a second control pulse and electrically coupled to the data voltage for receiving the data voltage; and a first storage capacitor, comprising a first electrode terminal and a second electrode terminal, the first storage capacitor being configured to have its first electrode terminal electrically coupled to the reference voltage through the second signal control switch and for receiving the data voltage through the third signal control switch, and its second electrode terminal for receiving the data voltage through the first signal control switch and for providing an output voltage;

a liquid crystal capacitor, comprising a first electrode terminal and a second electrode terminal, the liquid crystal capacitor being configured to have its first electrode terminal electrically coupled to the reference voltage and its second electrode terminal electrically coupled to the second electrode terminal of the first storage capacitor; and at least a second data line, electrically coupled to the corresponding booster circuit and for receiving the output voltage and providing the output voltage to at least a corresponding pixel;

wherein a ratio of a capacitance value of the first storage capacitor to a capacitance value of the liquid crystal capacitor is in a range from 0.125 to 4.

* * * * *